US005556080A

United States Patent [19]

Vise

[11] Patent Number: 5,556,080

[45] Date of Patent: Sep. 17, 1996

[54] FENCE SYSTEM

[75] Inventor: Larry L. Vise, Birmingham, Ala.

[73] Assignee: Alabama Metal Industries Corporation, Birmingham, Ala.

[21] Appl. No.: 407,616

[22] Filed: Mar. 21, 1995

Related U.S. Application Data

[63] Continuation-in-part of Ser. No. 58,577, May 6, 1993, Pat. No. 5,421,557.

[51] Int. Cl.[6] ..... E04H 17/16

[52] U.S. Cl. ..... 256/24; 256/21; 256/22; 256/54; 248/74.5; 411/399; 52/581; 52/483.1

[58] Field of Search ..... 256/24, 32–33, 256/54–55, 9, 5, 21–22, 29, 46–48, DIG. 3, 35; 248/11, 74.5, 301, 304, 227.1–227.4; 52/581, 478, 483.1

[56] References Cited

U.S. PATENT DOCUMENTS

| | | | |
|---|---|---|---|
| 297,382 | 4/1884 | Golding . | |
| 834,873 | 10/1906 | Curtis . | |
| 1,902,966 | 3/1933 | MacChesney . | |
| 2,053,254 | 9/1936 | Fairchild et al. . | |
| 3,022,044 | 2/1962 | Gugino | 256/47 |
| 3,592,492 | 7/1971 | Lind | 52/581 |
| 4,471,947 | 9/1984 | Osborne | 256/24 |
| 4,526,347 | 7/1985 | McLoughlin | 256/33 |
| 5,255,898 | 10/1993 | Cacicedo | 256/47 |
| 5,421,557 | 6/1995 | Vise . | |

FOREIGN PATENT DOCUMENTS

| | | |
|---|---|---|
| 215001 | 8/1961 | Austria . |
| 3245857A1 | 6/1984 | Germany . |

*Primary Examiner*—Kenneth J. Dorner
*Assistant Examiner*—Harry C. Kim
*Attorney, Agent, or Firm*—Trexler, Bushnell, Giangiorgi & Blackstone, Ltd.

[57] ABSTRACT

A fence system including a frame and a plurality of foraminous panels attached to the frame. The foraminous panels are constructed with continuous integral strands forming a zig-zag pattern defining cell apertures therebetween which are connected by integral bonds extending between each of the strands. The cell apertures define a non-circular interior shape. A fastener of the fence system has a shank, a head attached to one end of the shank, and may include a shoulder positioned between the shank which is shaped to cooperatively engage a cell aperture. The foraminous panels are attached to the frame with a portion of each neighboring panel having an overlapping area through which fasteners are inserted and attached. A reinforcing assembly including at least one reinforcing member attached over each overlapping area and may be attached over other joints or edges to provide added security. An angled top edge cap is attached along a top end of the foraminous panels and is angled to deter climbing. The top cap panel material is self-supporting but is incapable of supporting the weight of a climber. Additionally, barbed segments are formed along a terminal edge of the top cap by shearing one of the integral strands to provide extremely sharp pointed tips.

20 Claims, 7 Drawing Sheets

20
22
24
26
28
30
32
34
36
24a
24b
49
49a
49b
48
50
51
52
53
54
57
58
59
60
46
64
10
83
84
3

FENCE SYSTEM

CROSS REFERENCE

This is a Continuation-In-Part of U.S. patent application Ser. No. 08/058,577 filed May 6, 1993, issued as U.S. Pat. No. 5,421,557 on Jun. 6, 1995.

BACKGROUND

This invention pertains to fence systems and more particularly to fence systems having reinforcing assemblies for use with panels attachable to frames with the panels also being attachable over existing woven fabric fence material.

Fence systems and fence materials come in a wide variety of configurations. One of the most common types offence systems uses chain link fence material (also known as hurricane or cyclone fencing). The chain link fence system includes a woven "chain link" fence material which is stretched over and attached to a structural frame. The woven material includes a series of interlinking fence pickets. The fence pickets have a characteristic zig-zag pattern which facilitates the interlinking of the pickets. Each of the interlinking pickets is an independent body which is woven with neighboring pickets on each side. Often, terminal portions of the pickets are twisted on one end and knuckled on the other end to help retain the woven structure.

A frame or support structure used with a chain link fence system includes a series of vertical and non-vertical segments or posts and rails. The woven material is unrolled from large bails of material and cut to a desired length. Cutting involves separating the twisted terminal ends of the pickets or cutting off such terminal ends and unweaving one of the pickets from its neighbors. The selected piece of woven material is placed against the frame and stretched to mount the material against the frame in a tensioned manner. In this regard, the chain link fabric must be tensioned between at least two vertical segments of the frame.

The chain link fence system has several problems. First, the woven material, while providing a degree of deterrence, can be defeated quite easily. Because the chain link system employs a woven material, removal of one of the pickets allows a portion of the fence to be unraveled or spread apart in a curtain-like manner. As noted above, the pickets are easily removable by removing terminal ends of each picket and merely unweaving the picket from its neighboring pickets. An informal study indicates that a person skilled at penetrating chain link fence systems can create an opening in the woven material sufficient to drive a small car through in less than one minute.

An additional problem with the woven material used in chain link fencing systems is that it is easily climbable. The size and orientation of the chain link material forms a space sufficient for gripping and for providing a toehold to ease a climbers ascent. Additionally, the pickets are formed of a rounded wire material which provides a comfortable grip with no deterrent effect. As a result of these characteristics of the chain link material an intruder can quickly and easily climb the chain link fence system.

Various top cap barriers have been created in an attempt to deter climbing over the top of chain link fence systems. One type of top cap barrier employs an unraveled coil of barbed or razor tape wire mounted to the top of the chain link material. In many cases, the razor wire can be spread or pushed out of the way thus allowing a skilled intruder to easily pass over this type of top cap barrier.

In an attempt to overcome the ease which an intruder can pass over the coiled top cap material, an angled top cap was devised employing a series of barbed wire or razor tape wire rows. Once again, a sufficiently skilled and motivated intruder can actually employ these rows to support his weight while climbing over the top of such a structure.

Fence systems are increasingly more important to provide an initial perimeter barrier to secure items of value. As an example, many rail transfer yards are large expansive areas in which large quantities of valuable goods are stored while being transferred within the rail shipping system. Material storage areas are another area frequented by thieves. For example, railway companies may store large inventories of valuable material, such as copper cables, in open yards due to the size of the spools of cables. Such materials are valuable, easy to move and easy to sell making them prime targets for theft. These storage areas are especially prone to theft and vandalism due to the open and expansive nature of these storage and/or transfer yards and the inability to constantly monitor all areas of such a facility.

In an attempt to improve security, fences are erected around the perimeter of such a yard to deter casual intrusion. Skilled and motivated intruders easily scale or penetrate ordinary chain link fence systems. Video cameras and electronic monitors are often positioned to provide early warning as to penetration or intrusion. These systems, however, are somewhat easy to foil.

Even when a monitoring system is not foiled by an intruder, often the size of such a rail storage and/or transfer yard will result in sufficiently long response time to allow an intruder to steal or vandalize the contents of the yard. A lengthy response time is exacerbated by the extremely short time required to penetrate a chain link fence system. In other words, even though an intruder may be detected as entering the yard, the penetration time is so short and the yard area is so large that a security detail often times cannot get to the scene of the intrusion or theft in sufficient time to apprehend the intruders.

An additional problem with chain link fence systems is that they allow a convenient way for intruders to repeatedly penetrate and exit the perimeter barrier. In this regard, since the woven fence material can be unraveled, it can also be quickly, temporarily reconnected so as to appear to not have been breached. As such, once an intruder opens the woven fabric, if undetected while inside the perimeter, they can exit the same spot and try to repair the spot in an easily disassembled manner to use the same entry point on another visit. The repair can be made using small gauge wire which can be easily cut on the next visit. Often times, containers or other objects placed in front of the repaired point of penetration will obscure the breach in the fencing material from being located during a casual inspection.

As a result of the problems noted above, the defensive abilities of woven fence material of chain link fence systems has declined as the ability and motivation of intruders has increased. Additionally, the cost of securing an area has dramatically increased due to the need to provide additional monitoring of the perimeter barrier including expensive sensing and observation equipment and employees to operate and monitor such equipment. Additionally, even though monitoring equipment is employed, such equipment is prone to vandalism and ordinary break down thereby providing weak links in the overall security system. Due to the intruder skill and motivation of intruders and the frequency of intrusions insurance rates continue to climb. As a result of increasing intrusions, insurance costs and the cost of goods covered by such insurance continue to increase dramatically.

It is highly desirable to provide a fence system which is difficult to penetrate and climb in order to provide a highly reliable perimeter security barrier.

OBJECTS AND SUMMARY

A general object satisfied by the invention is to provide a fence system which is highly reliable, generally impregnable and does not require extensive monitoring.

Another object satisfied by the invention is to provide a reinforcing assembly which provides a deterrent to intrusion.

Still another object satisfied by the invention is to provide a fence system which can be erected independent of the location of the frame and which can be attached over existing chain link woven material fence systems.

Briefly, and in accordance with the foregoing, a fence system is envisioned including a frame and a plurality of foraminous panels attached to the frame. The foraminous panels are constructed with continuous integral strands forming a zig-zag pattern defining cell apertures therebetween which are connected by integral bonds extending between each of the strands. The cell lo apertures define a non-circular interior shape. A fastener of the fence system has a shank, a head attached to one end of the shank, and may include a shoulder positioned between the shank which is shaped to cooperatively engage a cell aperture. The foraminous panels are attached to the frame with a portion of each neighboring panel having an overlapping area through which fasteners are inserted and attached. A reinforcing assembly including at least one reinforcing member attached over each overlapping area and may be attached over other joints or edges to provide added security. An angled top edge cap is attached along a top end of the foraminous panels and is angled to deter climbing. The top cap panel material is self-supporting but is incapable of supporting the weight of a climber. Additionally, barbed segments are formed along a terminal edge of the top cap by shearing one of the integral strands to provide extremely sharp pointed tips.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which.

DETAILED DESCRIPTION

Figures 1, 2, 2A:
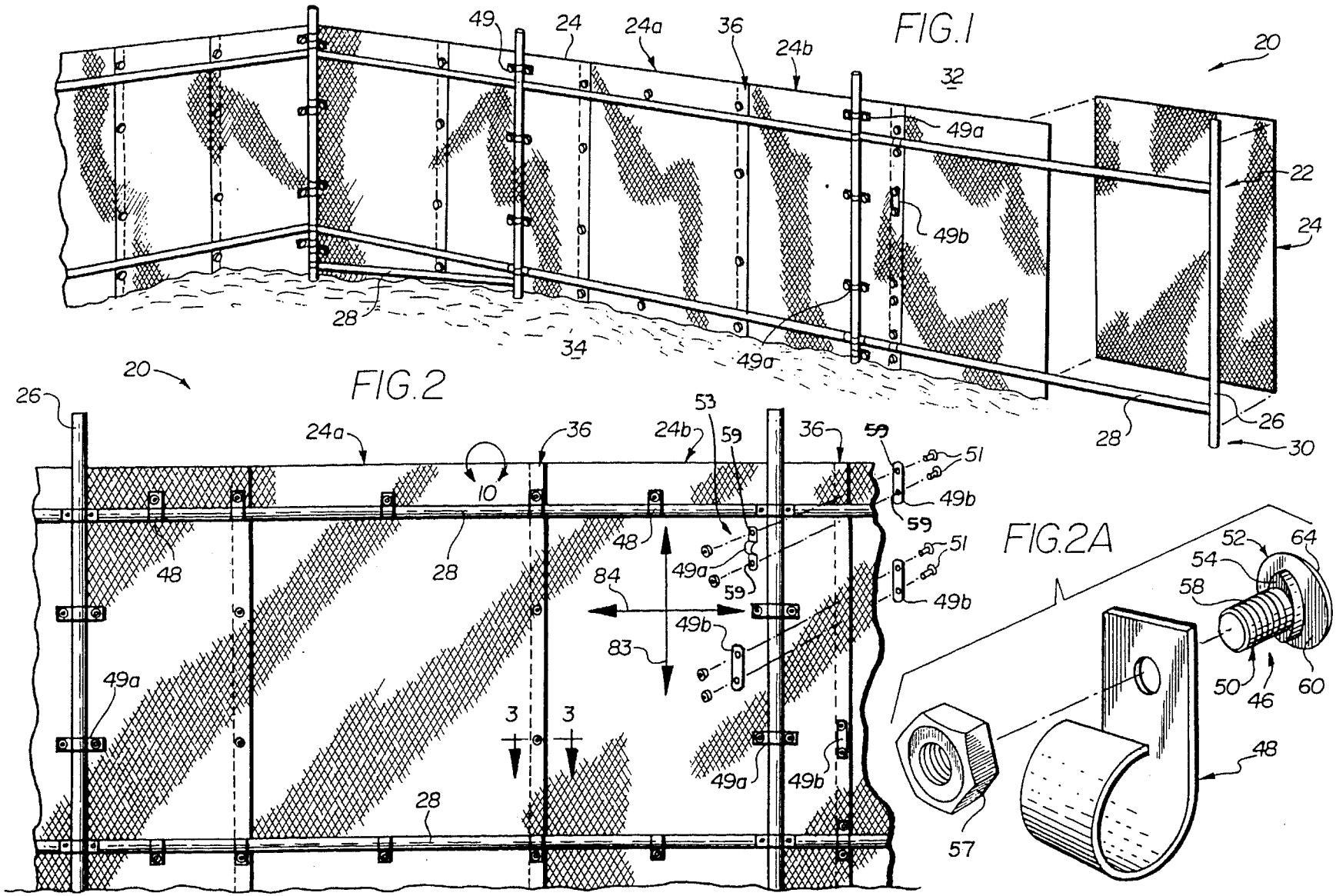
FIG. 1 is a perspective view of a fence system of the invention as viewed from a secure side of a barrier defined by the fence system.
FIG. 2 is an enlarged, partial fragmentary, elevational view of the fence system as shown in FIG. 1 showing foraminous panels being positioned with an overlapping area and being fastened to neighboring panels.
FIG. 2A is an enlarged, exploded, perspective view of a fastener and a single-sided fitting used in the fence system as shown in FIGS. 1 and 2.

While the invention may be susceptible to embodiment in different forms, there is shown in the drawings, and herein will be described in detail, an invention with the understanding that the present description is to be considered an exemplification of the principles of the invention and is not intended to limit lo the invention to that as illustrated and described herein.

FIG. 1 provides a perspective view of a fence system 20 which includes a frame or support structure 22 and a plurality of foraminous panels 24 which are attachable to the frame 22. The frame 22 includes vertical segments or posts 26 and non-vertical segments or rails 28. When the panels 24 are attached to the frame 22 the fence system defines a barrier 30 having an attack side 32 and a secure side 34. Neighboring panels 24 are positioned on the support structure 22 to provide an overlapping area 36. As described in greater detail below, a reinforcing system 35, including an elongated reinforcing member 37 positioned on the overlapping area 36, is attached to the panels 24 and structure 22.

Figure 4:
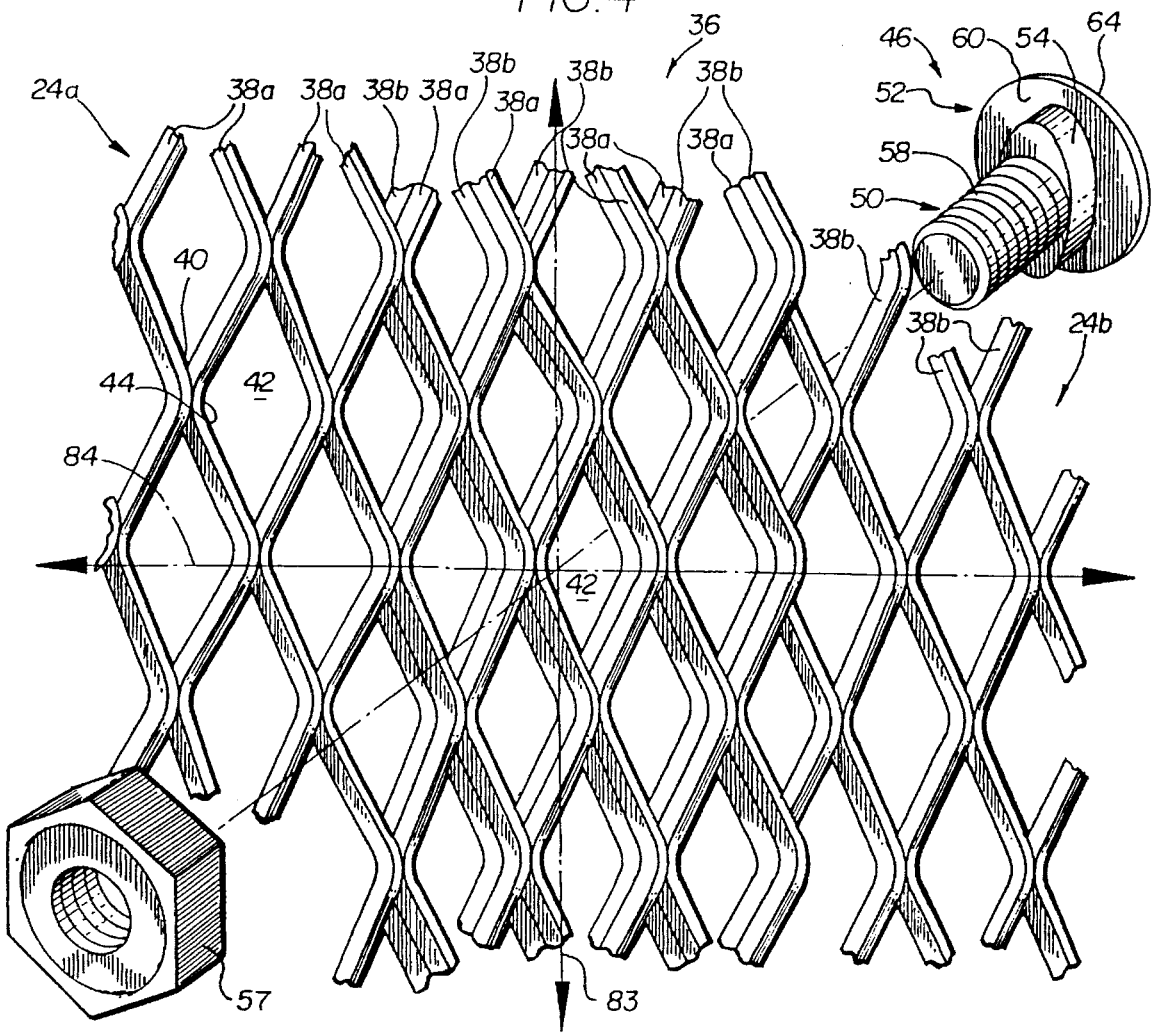
FIG. 4 is an enlarged, partial fragmentary, exploded, perspective view of the fastener and nut as shown in FIGS. 2 and 3 as viewed from a secure side of the barrier defined by the fence system.
Figures 5, 6:
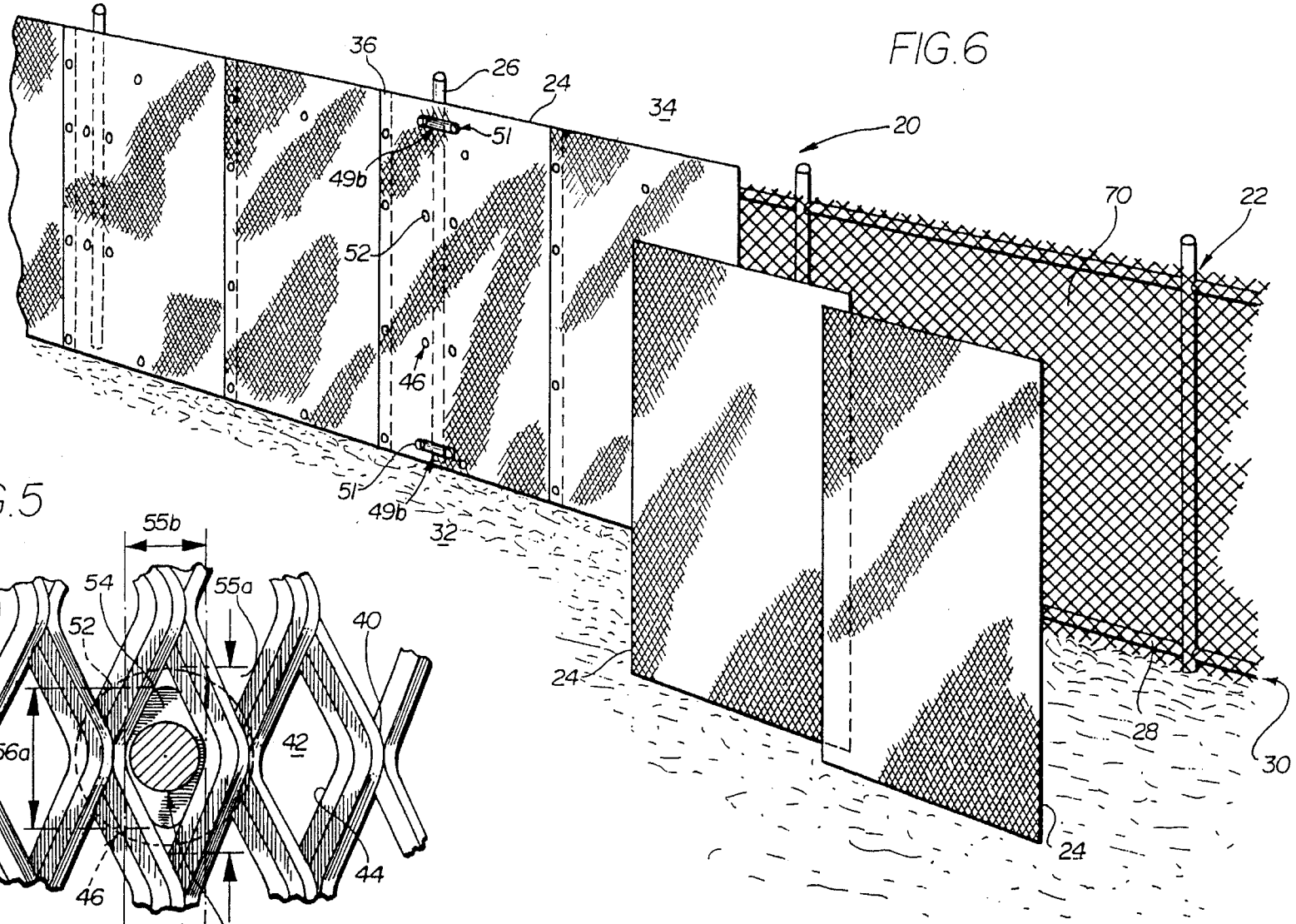
FIG. 5 is an enlarged, partial fragmentary, cross-sectional, elevational view of the fastener taken along line 5—5 in FIG. 3 showing a shoulder of the fastener engaged with a cell aperture in the overlapping area of the nested foraminous panels.
FIG. 6 is a partial fragmentary, perspective view of the fence system of the invention in which panels are attached to an existing woven material fence.

FIGS. 4 and 5 provide enlarged detail views of partial fragmentary sections of the foraminous panels 24. Each panel 24 is formed with a multiplicity of openings or cells 42. Each panel 24 is comprised of a plurality of integral strands 38 and integral bonds 40 formed between, and integrally joining, neighboring strands 38. As such, each strand 38 is integrally connected at spaced apart locations by integral bonds 40 with at least one neighboring strand 38. The integral strands 38 and bonds 40 are formed by slitting or shearing a continuous metal plate and expanding the plate along the sheared lines. A product formed by this process is known as "expanded metal". It should be noted that while expanded metal is shown, other foraminous panel material may be used with the reinforcing system 35 of the present invention.

Figure 3:
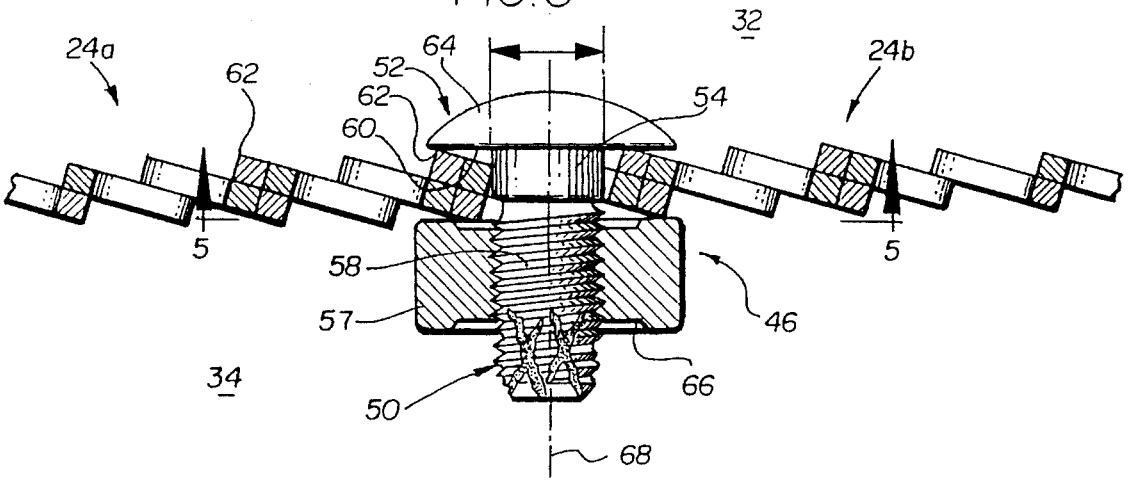
FIG. 3 is a partial fragmentary, cross-sectional, plan view taken along line 3—3 in FIG. 2, showing a fastener extending through the overlapping area defined by two foraminous panels having strands which are nested in the overlapping area.

The strands 38 are generally vertically oriented to minimize the horizontal surface effect of the panel 24 thereby eliminating finger grips and toeholds which might otherwise be available to a climbing intruder. As shown in FIG. 3, the vertically oriented strands provide a vertically oriented surface essentially devoid of any horizontal gripping features.

Cell apertures or cells 42 are defined between neighboring strands 38 of the foraminous panel 24 and at least two spaced-apart bonds 40. The cell apertures 42 define an interior surface 44. With reference to FIGS. 4, the overlapping area 36 of two neighboring panels 24*a*, 24*b* results in the strands 38*a* of one panel 24*a* nesting against the strands 38*b* of the second panel 24*b*. In other words, as shown in FIG. 4, the strands 38*a* of a first panel 24*a* nest against the strands 38*b* of a neighboring second panel 24*b*. The nesting of the two panels 24*a*, 24*b* enhances the security effect of the panels 24 in the overlapping area 36 as shown in FIG. 1.

Figure 2B:
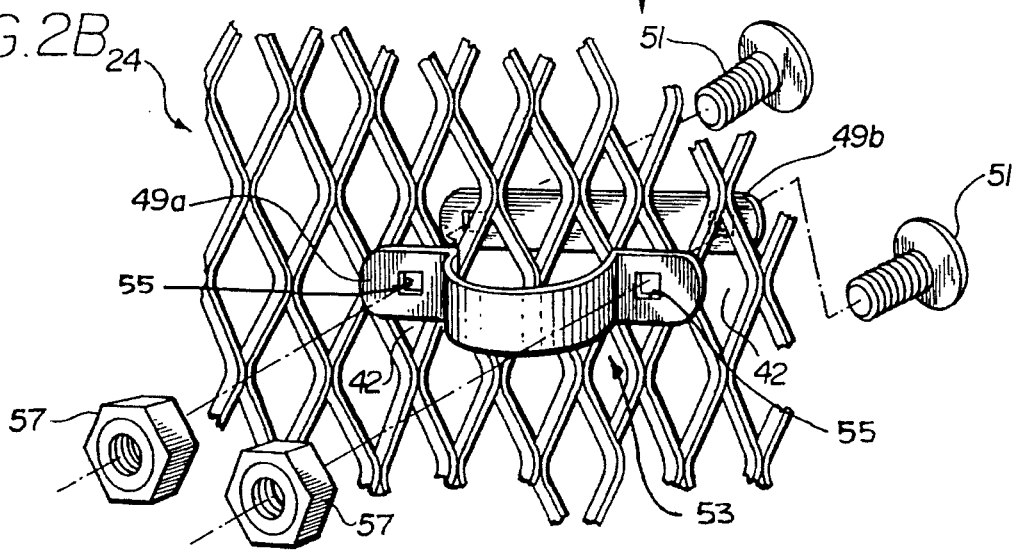
FIG. 2B is an enlarged, exploded, perspective view of a two-sided fitting used in the fence system as shown in FIGS. 1 and 2.

With further reference to FIGS. 3–5, a fastener 46 extends through a selected cell aperture 42 of at least one panel 24, and preferably the cell apertures of two nested, overlapping panels. As can be seen in FIGS. 1, 2, 6, and with further reference to FIGS. 2A and 2B, the fastener can also be used to attach a panel 24 to a single-sided fitting (as shown in FIG. 2A), a pre-curved or partially arcuate portion or band 49*a* (as shown in FIG. 2B), and a generally planar two-sided fitting 49*b*. Additionally, the fittings 48, 49*a*, 49*b* can be attached to the fence system 20 using fasteners 51 as shown in FIGS. 2 and 2B. The reinforcing system 35 further comprises the fitting assembly 53 including the partially arcuate band 49*a* and a generally planar band 49*b*. The planar band 49*b* is positioned on the attack side of the barrier. Fasteners 51 extend through apertures 59. The fitting assembly 53 further strengthens the fence system and deters breach of the barrier.

The single-sided fitting 48 is attached using a fastener 46 or 51 and is retained on the secure side 34 of the fence system 20. As shown in FIGS. 1 and 2, the single-sided fitting 48 can be used to attach a panel 24 to both the posts 26 as well as the rails 28. The two-sided fitting 49*b* is vertically oriented over an overlapping area 36. The fitting 49*b* includes a pair of apertures formed therethrough for receiving a fastener 46, or 51. The fasteners 46 or 51 are inserted through the attack side 32 of the panel 24 and extend through corresponding cell apertures 42 and through the apertures in the fitting 49*b*. As shown in the exploded view of the fitting 49*b*, two plates are provided with the plate on the attack side 32 preventing the fastener 51 from passing through the cell aperture 42. The pre-curved, two-sided fitting 49*a* functions in essentially the same manner as the fitting 49*b* except that the center portion of the fitting 49*a* is curved to straddle a post 26 or a rail 28 (the post or rail 26,28 is omitted from FIG. 2B in the interest of clarity).

The fastener 46 includes a shank 50 and a head 52 on one end of the shank 50. A shoulder 54 of the fastener 46 is positioned between the shank 50 and the head 52. The shoulder 54 has a non-circular outside shape which is the inside surface 44 of the cell aperture 42 which enhances the security effect when the inside surface 44 is cooperatively non-circular for engaging the noncircular shoulder 54. As shown in FIGS. 3 and 5, the non-circular shape of the shoulder 54 prevents rotation of the fastener 46 in the cell aperture 42.

The shoulder 54 has a generally diamond shape as does a cooperatively formed cell aperture 42. The cell aperture 42 has a major axis 55*a* and a minor axis 55*b*. The shoulder 54 has a first axis 56*a* and a second axis 56*b*. The dimension of the second axis 56*b* is substantially equal to the minor axis 55*b* of the cell aperture 42 and the dimension of the first axis 56*a* ranges from substantially equal to the minor axis 55*b* to substantially equal to the major axis 55*a*.

A retaining portion 57, shown in the illustrations as a nut, threadedly engages cooperatively formed threads 58 formed on the shank to hold the fastener 46 in engagement with a panel 24. Tightening of the nut 57 on the shank 50 draws the shoulder 54 into intimate engagement with the inside surface 44 of the cell aperture 42. As an additional consideration, while a threaded fastener 46, 51 is shown with a nut 57, the fastener 46, 51 and retaining portion 57 may be any of a variety of devices, techniques or methods for attaching the panels to the support structure, reinforcing member to the fence system and the fittings to the fence system.

As shown in FIG. 3, an abutting surface 60 of the head 52 abuts crests 62 of neighboring strands 38 to shield the shank 50 and the shoulder 54. Shielding of the shank 50 and shoulder 54 prevents an intruder from wedging a tool between the head 52 and the panels 24 to knock the head off of the fastener to dislodge the fastener 46 from the panels 24. As an additional deterrent, the head 52 has a convex surface 64 which resists gripping. Further, the threads 58 of the fastener 46 are scarified or damaged 59 to prevent removal of the nut 57 from the fastener 46. A recess 66 on the nut 57 allows the threads to be scarified further along an axis 68 of the shank thereby preventing disengagement of the nut 57 from the shank 50.

With reference to FIG. 1, the nuts are on the secure side 34 of the barrier 30. FIG. 6 provides a view of the fence system 20 of the present invention attached to an existing woven fence material or chain link material 70 and showing the heads 52 positioned on the attack side 32.

Figure 7:
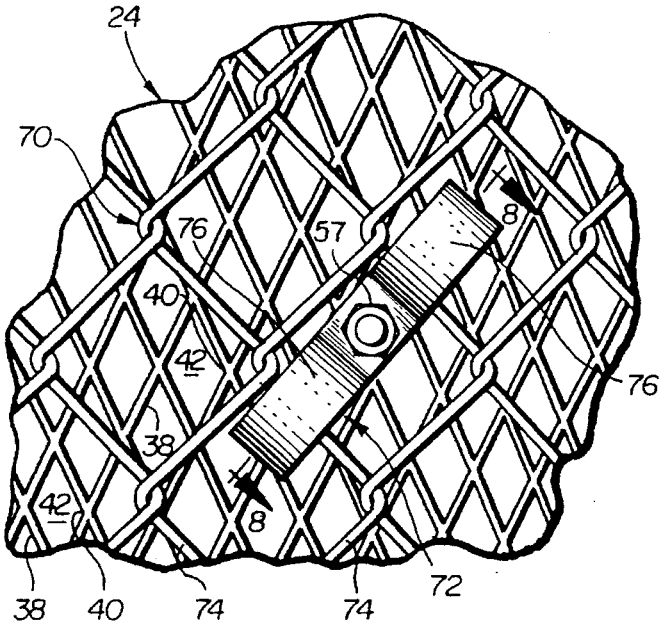
FIG. 7 is an enlarged, partial fragmentary, elevational view of a bracket used to secure foraminous panels to woven fabric material.

With further reference to FIG. 6, panels 24 are attached directly over existing woven fence material 70. The panels 24 include the overlapping area 36 as described hereinabove. FIG. 7 provides an enlarged view of a panel 24 attached over existing woven fence material showing a bracket 72 which is employed to secure the panel 24 to the chain link material 70. As can be seen in FIG. 7, the chain link material 70 includes a series of interlinking zig-zag pickets 74 which engage and interlink with neighboring pickets 74,74.

Figure 8:
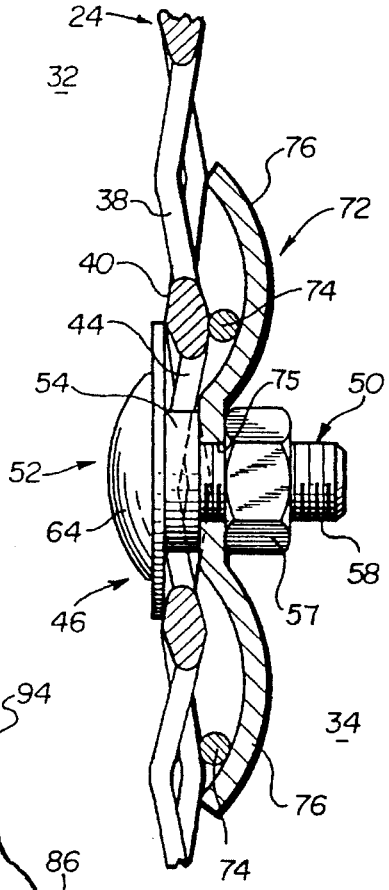
FIG. 8 is a partial fragmentary, cross-sectional, plan view of the bracket in FIG. 7 taken along line 8—8 in FIG. 7.

The bracket 72 is mounted to the secure side 34 of the barrier 30, with the shank 50 of a fastener 46 extending through an aperture 75 formed through a center section of the bracket 72. As further shown in the side view of FIG. 8, two arms 76 of the bracket 72 extend to overlie at least two pickets 74. The fastener 46 is inserted through a cell aperture 42 of the panel 24 from the attack side 32. As such, only the convex surface 64 of the head 52 is exposed to the attack side 32. The bracket 72 is engaged with the fastener 46 on the secure side 34. As described hereinabove, the shoulder 54 of the fastener 46 prevents rotation of the fastener 46 and the nut 57 secures the bracket 72 against the secure side 34 of the woven fence material 70.

Figure 9:
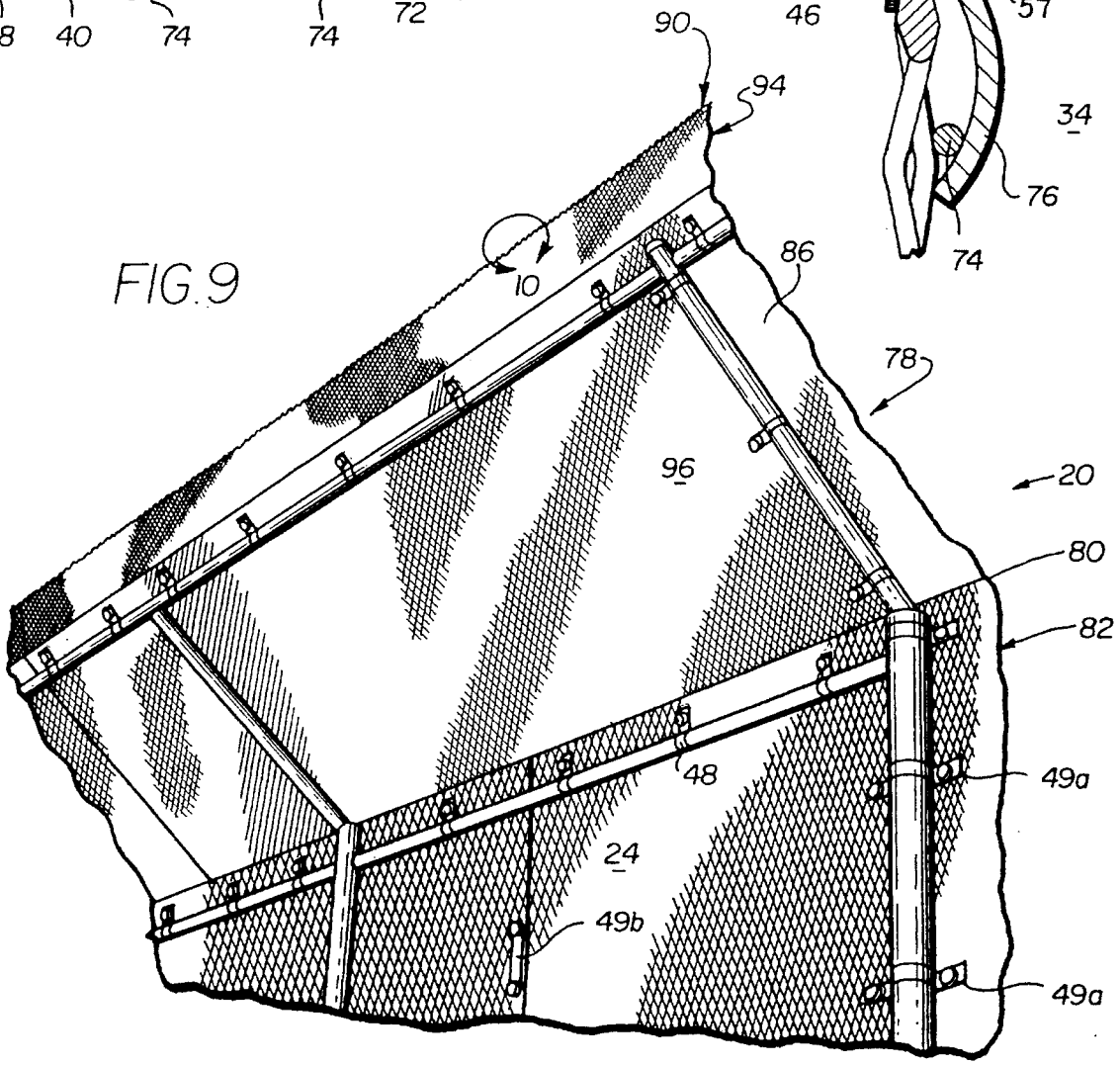
FIG. 9 is a partial fragmentary, perspective view of a top cap attached to lower panels of the fence system.

FIG. 9 provides an illustration of a top cap 78 of the fence system 20 attached along a top edge 80 of lower panels 82. The lower panels 82 are configured as described hereinabove with reference to FIGS. 1–8. With further detailed reference to FIG. 4, panels 24 are formed by expanding a continuous metal sheet which has been slit in a predetermined pattern. The integral strands 38 in the panel are oriented in a longitudinal direction along a strand axis 83. As such, each panel 24 is elongated along a direction of expansion (as indicated by arrow 84 in FIG. 4) generally perpendicular to the strand axis 83.

Referring back to FIG. 9, the lower panels 82 are oriented with strands axes 82 in a vertically aligned direction. The top cap 78 is constructed with panels 86 having the strand axis 83 directed horizontally or, in other words, perpendicular to the strand axis 83 of the lower panels 82. Additionally, the top cap 78 panels 86 have a cell aperture 42 which is smaller than a cell aperture of the lower panels 82. By orienting the strand axis 83 of the top cap 78 panels 86 perpendicular to the strand axis 83 of the lower panels 82, a barbed segment 88 can be achieved along a terminal edge 90 of the top cap 78.

Figure 10:
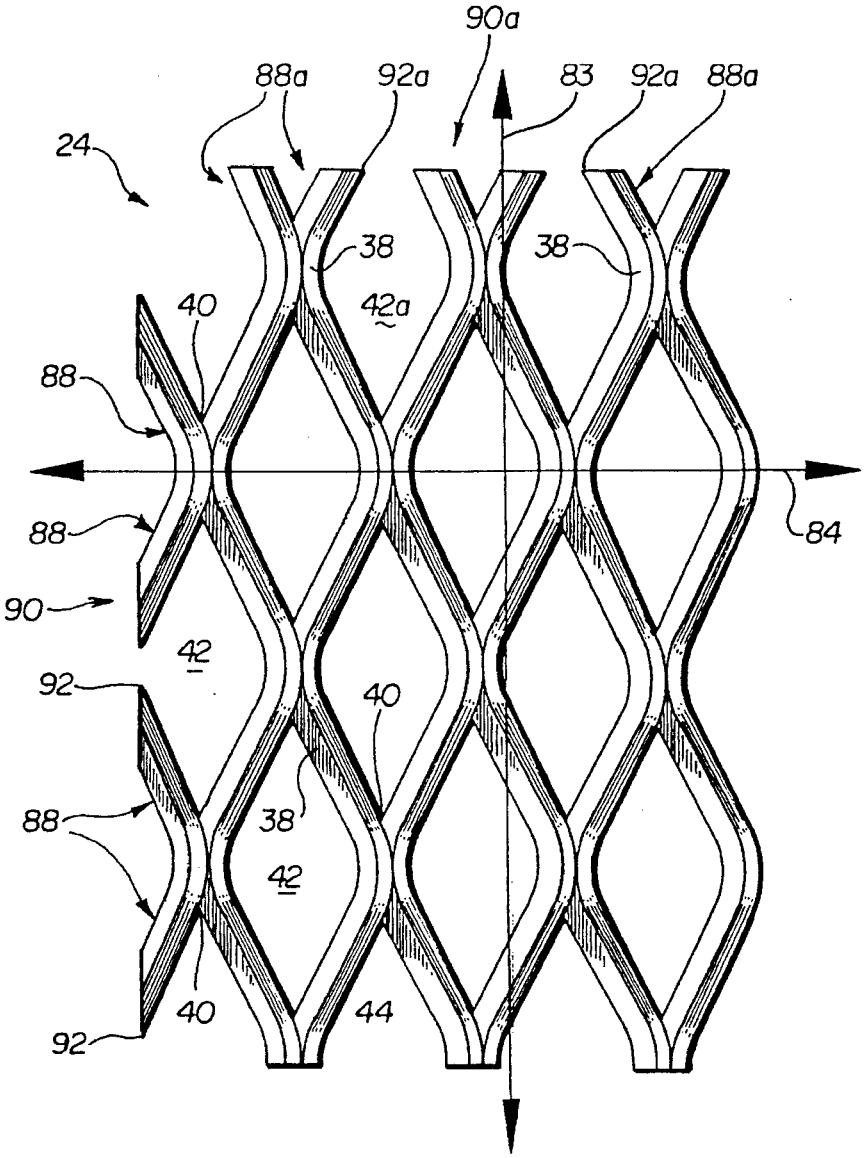
FIG. 10 is an enlarged, partial fragmentary, elevational view of a portion of a terminal edge of a foraminous panel showing barbed segments formed by shearing a strand to provide pointed tips on the ends of the barbed segments.

FIG. 10 provides an enlarged illustration of a representative section of panel 24 each side of which is prepared in one of the four general configurations of the present fence system 20. A first terminal edge 90 having barbed segments 88 disposed thereon is shown on the left side of FIG. 10. The barbed segments 88 include a severely pointed tip 92 extending along the first terminal edge 90. The barbed segments 88 and pointed tips 92 are formed by "random" shearing a panel 24 along an integral strand 38 spaced away from a series of integral bonds 40. By cutting the integral strand 38 at a distance away from the corresponding integral bonds 40, the cell aperture 42 is no longer a closed aperture. It should be noted that the barbed segments 88 have an end opposite the tip 92 which remain intact and integral with the integral bonds 40 of the neighboring integral strand 38.

The top side of FIG. 10 illustrates a second terminal edge 90*a*. The features of the second terminal edge 90*a* corresponding to the features of the first terminal edge 90 are identified with an alphabetic suffix. The second terminal edge 90*a* is formed in a similar manner as the first terminal edge 90. The second terminal edge 90*a* is used along the tops of the vertically oriented panels 24 as shown in FIGS. 1, 2, 6, and 9. The second terminal edge 90*a* includes a second barb segment 88*a* having second pointed tips 92*a*. As a result of random shearing the cell apertures 42 generally parallel to the direction of expansion 84, the resulting barb segments 88*a* are very sharp and provide a climbing deterrent. The right and bottom sides of FIG. 10 show closed shear edges.

An additional climbing deterrent is provided in an unsecured and unsupported top strip 94 on the top cap 78. The top strip 94 is formed by bending the top cap panels 86. The top strip 94 provides a further deterrent in that even if an intruder is capable of climbing the lower panels 82 and an angled portion 96 of the top cap 78 the top strip 94 will give way since it is unsupported. The top strip 94 will not bend or flex under normal environmental conditions but will flex under the weight of a climber. If a climber is unable to be supported by the top strip 94, the climber will not be able to overcome the top cap 78 and will be prevented from climbing over the terminal edge 90.

Figure 11:
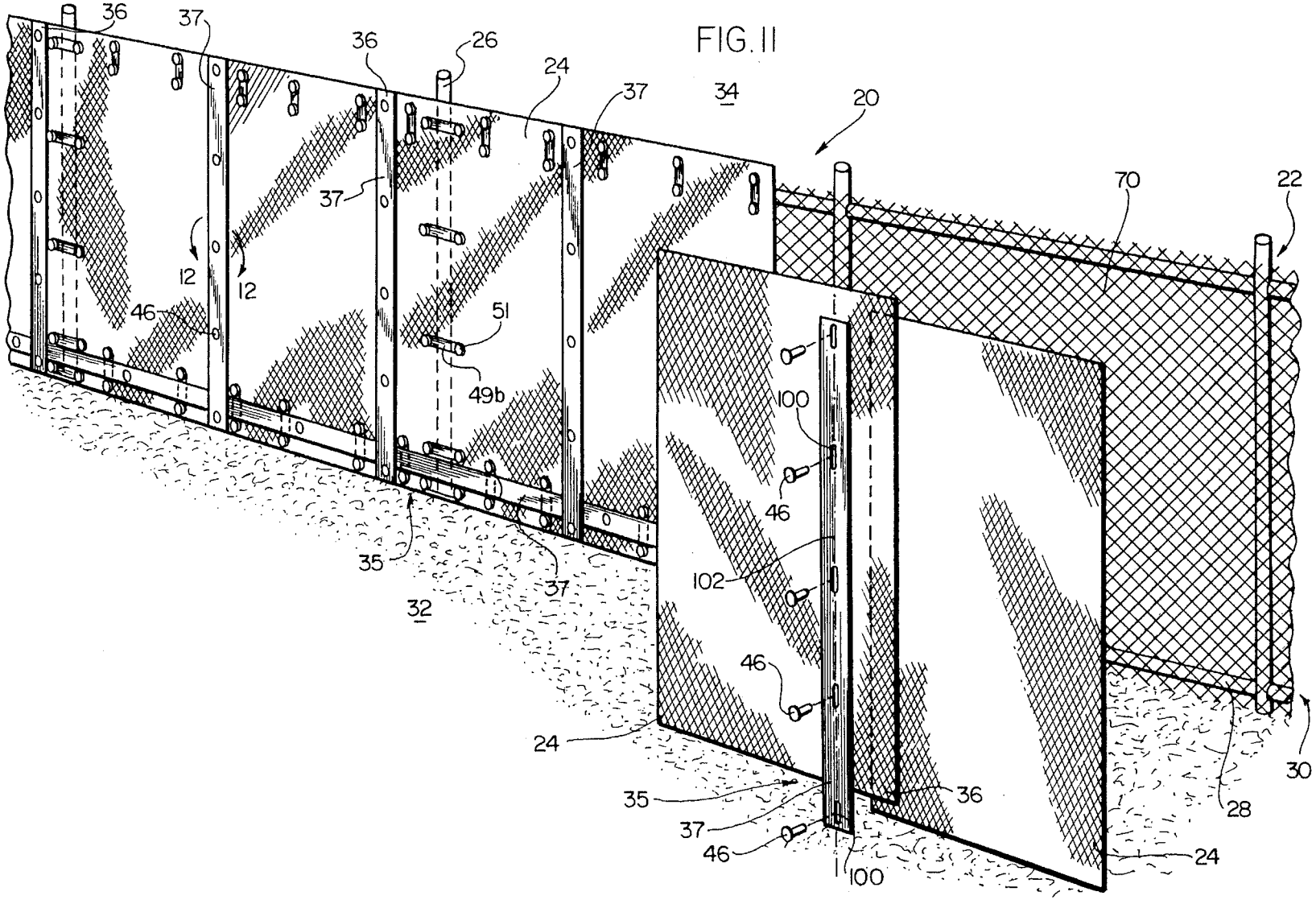
FIG. 11 is a partial fragmentary, perspective view of the attack side of the fence system of the invention in which panels are attached to an existing woven material fence and horizontal and vertical reinforcing members are secured over edge areas, joints or overlapping areas on the attack side of neighboring foraminous panels.
Figure 13:
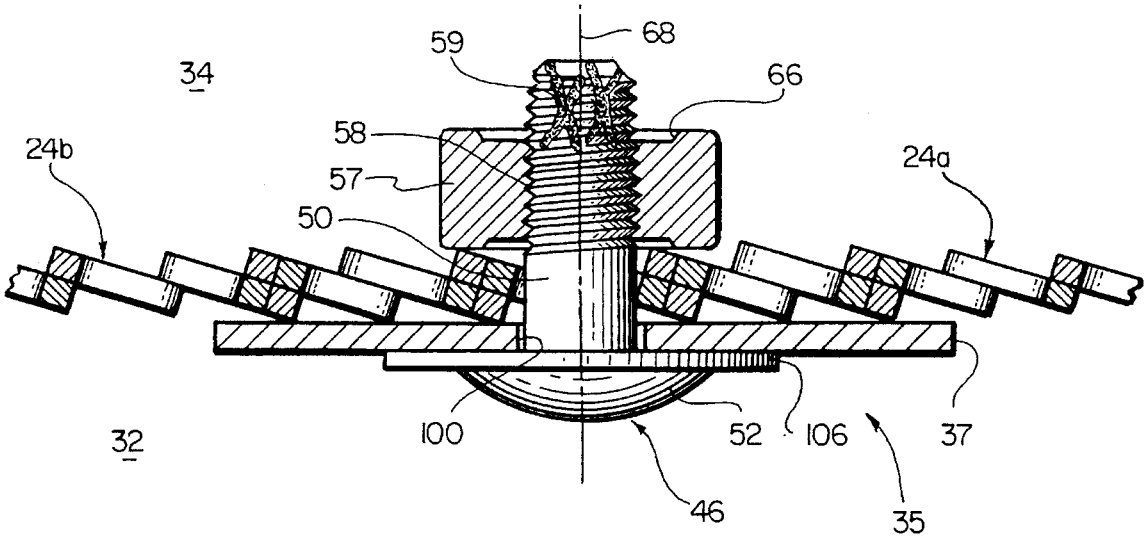
FIG. 13 is an enlarged, partial fragmentary, cross-sectional, plain view taken along line 13—13 in FIG. 12, showing a reinforcing member positioned over an overlapping area of two nested, neighboring panels and a fastener extending through the reinforcing member and a pair of aligned cells of the nested, neighboring panels.
Figure 12:
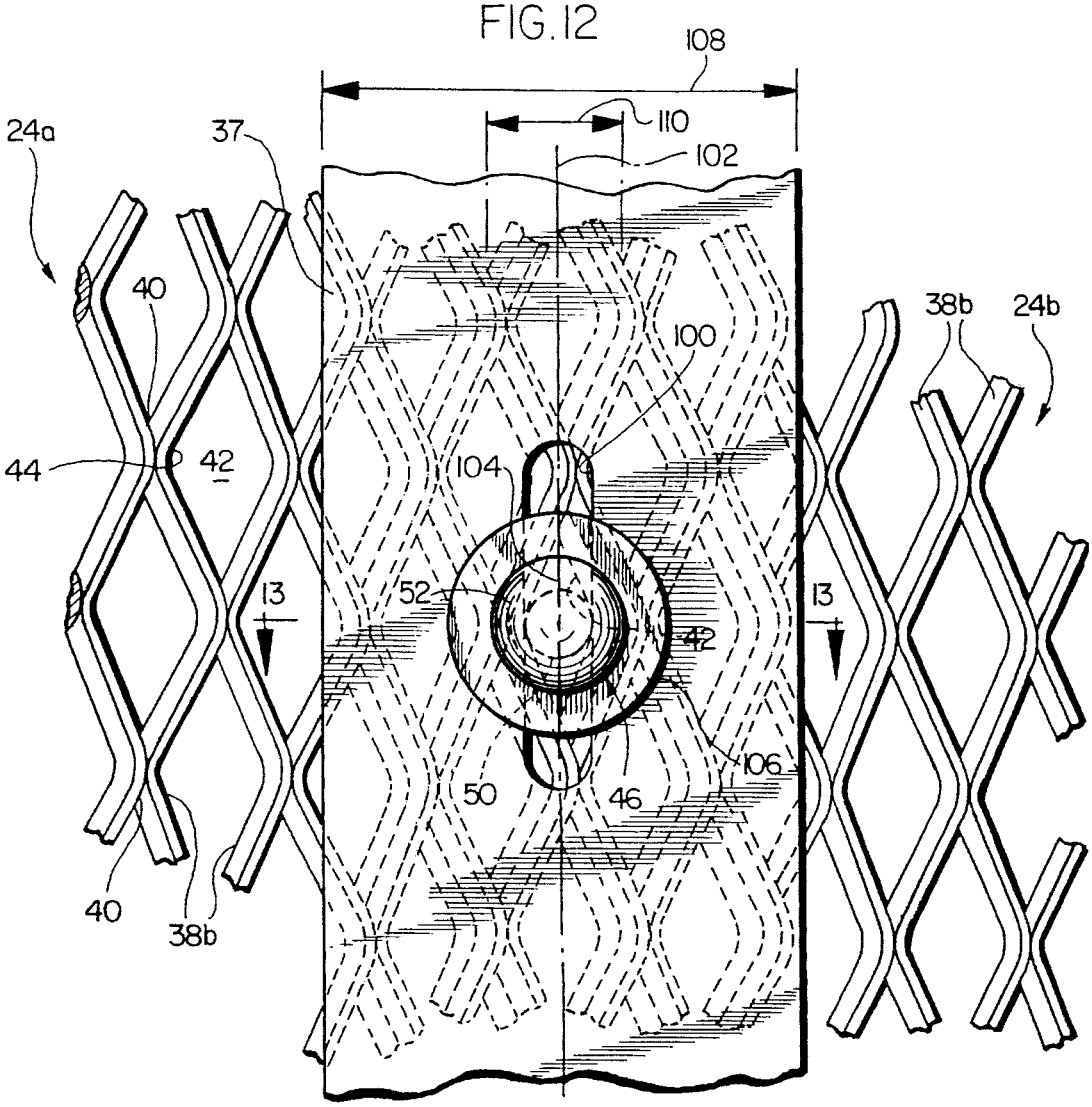
FIG. 12 is an enlarged, partial fragmentary, exploded, perspective view of a portion of a reinforcing member vertically oriented and attached to the attack side of the barrier defined by the fence system by a fastener extending through an elongated aperture in the reinforcing member.

With further reference to FIGS. 11–13, the fence system 20 includes a reinforcing system 35 to provide an additional security feature and deterrent. The reinforcing assembly 35 presents a rather formidable barrier when combined with the foraminous panels 24 as described and discussed hereinabove. The reinforcing assembly 35 includes elongated reinforcing members 37 which are secure to the foraminous panels 24 by fasteners 46. The reinforcing members 37 are formed with spaced apart elongated apertures 100 formed through the reinforcing members 37. Each elongated reinforcing member 37 defines an elongated or primary axis 102 and the elongated apertures define a second axis 104, shown in FIG. 12 coincident with the primary axis 102. The elongated apertures 100 allow the reinforcing member 37 to be adjusted to align the apertures 100 with the cells in the panels. As more clearly shown in FIGS. 12 and 13, a force distributor or washer 106 is provided between the head 52 of the fastener 46 and the reinforcing member 37. The nut 57 is secured to the threads 58 of the fastener 46 whereupon the threads may be scarified or damaged 59 to prevent removal of the nut 57 from the fastener 46.

A reinforcing member 37 is preferably placed over every overlapping panel area or panel joint 36 so as to prevent access to the edge of the top positioned neighboring panel 24*a* and so as to provide an integrating reinforcement member to prevent the edge of the panel from being displaced. As shown in FIG. 11, there is only one vertical reinforcing member 37 positioned over the overlapping area 36. It should be understood that, depending on the vertical dimension of the fence panels and the corresponding reinforcing member 37, more than one reinforcing member 37 may be used, in an end overlapping or end-to-end butt fashion, to extend over substantially the entire vertical distance. This is shown with regard to the horizontally configured reinforcing members. Also, a width dimension 108 of the reinforcing member 37, measured generally transverse to the axis of elongation 102, is generally equal to the width of the overlapping area and at least as wide as a width dimension 110 of one cell within the overlapping area. More specifically, the fasteners 46 are spaced apart approximately every two feet so as to provide secure attachment of the reinforcing member 37 to the corresponding panels 24*a*, 24*b*. This spacing or closer spacing if necessary, deters intruders from trying to remove the fasteners 46. The close spacing is a deterrent since multiple fasteners would need to be removed in order to displace the reinforcing member 37 and a portion of the panel 24 in order to make a sufficiently large opening for a person to climb through the barrier 30. Typically, an intruder can find relatively easy ways to enter the area protected by the barrier but an opening must be provided to allow the intruder to escape the protected area. In other words, even though an intruder may quickly and easily climb over the barrier from the attack side 32 to gain access to the area on the secure side 34, the intruder will need an opening in the barrier 30 in order to quickly and easily escape through the barrier 30. Additionally, intruders prefer to have an access through the barrier 30 in order to quickly and easily remove items from the area on the secure side 34. Primarily, intruders rely on areas along the base of a barrier which may be less secure, thereby exploiting the weakness, of perhaps a joint, in the barrier. The lower edge also would allow an intruder to have some form of cover below a security officer's visual horizon. The invention provides reinforcing members 37 which are both vertically oriented along the overlapping areas or panel joints 36, as well as horizontally positioned along the lower area of the panels.

In use, the fence system 20 of the present invention includes the panels 24 mounted to the frame 22 with an overlapping area 36 between neighboring panels 24. The panels 24 are secured to the frame 22 using appropriate fittings 48, 49*a*, 49*b* which attach around the posts and rails 26,28 of the frame 22 and are secured thereto using the fasteners 46 and nuts 57. As shown in FIGS. 1–3, the nuts 57 are positioned on the secure side 34 of the barrier 30 with the heads 52 of the fasteners 46 on the attack side 32 thereby lo reducing opportunities for intruders to break or otherwise force the fasteners 46 from the panels 24.

The panels 24 are positioned with an overlapping area 36 in which the integral strands 38*a* of a first panel 24*a* nest with the integral strands 38*b* of a second panel 24*b*. The fasteners 46 are inserted through the cell aperture of the nested panels 24*a*, 24*b*, with the shoulder 54 engaging an inside surface 44 of the cell aperture 42. The shoulder 54 is sized and dimensioned to prevent rotation of the fastener 46 and the cell aperture 42.

The fastener 46 head 52 has a convex surface 64 which prevents gripping and an abutting surface 60 which abuts crests 62 of the strands 38. When the head 52 is drawn tightly against the panel 24, the head 52 prevents access to the shank 50 thereby preventing removal of the head and disassembly of the fastener 46. Additionally, by positioning the head 52 on the attack side 32, the additional material of the shoulder 54 further reinforces the fastener 46 to prevent forcible removal of the head 52.

The fence system 20 of the present invention is also "retrofittable" onto existing chain link fences. The frame 22 is already in place to support the woven fence material 70. Panels 24 are positioned on the attack side 32 with overlapping areas 36 and are attached to the frame 22 and to the woven fence material 70. The bracket 72 is positioned on the secure side 34 and attached with a fastener 46. The arms 76 extending from the bracket 72 overlie and engage the independent, interlinkable pickets 74 of the woven fence material 70 to secure the panels 24 thereto.

The fence system 20 of the present invention provides a reliable lo and highly impenetrable barrier against intrusion. While almost any fence can be climbed or penetrated, given sufficient time, the present fence system 20 is essentially impenetrable or climbable in a sufficiently short time period to avoid detection and apprehension. The construction of the panels prevents penetration because it is almost impossible, within a practical time period, to cut or torch a sufficiently large hole through a panel 24. In order to cut through the panel 24, 40–70 individual cuts must be made through the integral strands 38 or bonds 40 to provide even a small "man-sized" hole. Torching through the material requires as many cuts and there is no thermal wave effect to speed up the cutting process because the integral strands 38 and bonds 40 are spaced apart.

In order to make the present invention an even more formidable barrier, the reinforcing members 37 would be applied in a horizontal, vertical or combined horizontal and vertical arrangement to prevent an intruder from exploiting the overlapping or panel joint areas 36. The reinforcing members 37 are attached over the panel joints 36 as the panels are assembled to the frame 22 or fitted over existing fence materials such as chain link. For example, a reinforcing member 37 is vertically positioned over a joint 36 and the fasteners 46 are inserted through the elongated apertures 104. The apertures 104 are elongated to allow the fastener to be positioned with the shank 50 extending through a corresponding coaxially aligned pair of a cell apertures 42. Once the fasteners 46 are positioned, the nuts 57 can be attached to the threaded portion of the shank 50 on the secure side 34.

The material used in the panels 24 results in a rigid, generally self-supporting panel 24 which conveys an impressive security appearance. In other words, the panels 24 are rigid surfaces which do not shake or flex in the same manner as chain link fence. The fasteners 46 are constructed to prevent removal from the panel 24 and therefore prevents disassembly of the panels 24 from the frame 22. Further, the vertical orientation of the integral strands 38 prevents climbing. As an additional matter, by fabricating the foraminous panels 24 by expanding a continuous sheet of metal each exposed edge of each strand 38 is formed has a sharpened edge. The sharpened edge is work hardened during the forming process and thus retains its edge over a long period of time.

The present invention provides the impressive security appearance as discussed hereinabove while providing visibility through the cell apertures 42. Additionally, the present fence system 20 is uncomplicated and easy to assemble and substantially troublesome to penetrate or scale. It is expected that intruders encountering the fence system 20 of the present invention will forego attempts to penetrate the system and seek security systems which are easier to foil.

While an embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A fence system comprising:

a support structure;

a plurality of foraminous panels attached to said support structure, each of said foraminous panels having a plurality of open cells therein;

a barrier being defined by said plurality of said panels attached to said support structure, said barrier defining an attack side and a secure side;

a fastener having a shank and a head formed on one end of said shank;

a retaining portion attachable to said shank for securing said fastener to said panel;

neighboring panels of said plurality of panels having overlapping portions defining an overlapping area, said neighboring panels being oriented for aligning a plurality of corresponding cells in said overlapping area; and at least one elongated reinforcing member having a plurality of apertures therein positioned over said overlapping area on said attack side of said barrier with corresponding ones of said fasteners extending through said apertures in said reinforcing member and through said neighboring foraminous panels in said overlapping area, said fasteners extending through said apertures in said reinforcing member for securing said reinforcing member to said attack side of said barrier, said reinforcing member strengthening said overlapping area and providing additional deterrence to prevent a breach of said barrier.

2. A fence system as recited in claim 1, wherein said elongated reinforcing member defines a primary axis of elongation, at least one of said apertures in said reinforcing member being an elongated aperture extending along a second axis of elongation relative to said primary axis of elongation of said elongated reinforcing member for adjusting said elongated reinforcing member relative to said overlapping area to substantially align said apertures with corresponding ones of said open cells in said neighboring foraminous panels in said overlapping area.

3. A fence system as recited in claim 1, further including a force distributor positioned on said attack side between said head of said fastener and said reinforcing member for distributing the forces created by said fastener against said reinforcing member over a greater area of the abutting surface of said reinforcing member proximate to said fastener.

4. A fence system as recited in claim 1, further comprising at least one horizontally oriented reinforcing member and at least one vertically oriented reinforcing member, said at least one vertically oriented reinforcing member being secured to said panels of said fence system extending over said overlapping area of the neighboring foraminous panels.

5. A fence system as recited in claim 1, further comprising at least one horizontally oriented reinforcing member and at least one vertically oriented reinforcing member, said at least one vertically oriented reinforcing member being secured to said panels of said fence system extending over said overlapping area of the neighboring foraminous panels, and said at least one horizontally oriented reinforcing member being secured to a lower portion of said foraminous panels attached to said support structure.

6. A fence system as recited in claim 1, further comprising a firing assembly attachable to said panel and said support structure, said fitting assembly comprising:

at least one generally planar fitting band having two apertures therethrough at spaced apart locations, said generally planar fitting band being positioned on said attack side of said barrier;

at least one partially arcuate fitting band having two apertures therethrough at spaced apart locations generally coincident with said apertures in said generally planar fitting band, said partially arcuate fitting band being positioned on said secure side of said barrier, said arcuate fitting band overlying a portion of said support structure;

a fitting assembly fastener extending through aligned pairs of said apertures of said generally planar fitting band, said partially arcuate fitting band, and through a corresponding cell of said foraminous panel between said aligned pairs of said apertures for attaching said fitting assembly to said panel; and a fitting assembly retaining portion attachable to said fitting assembly fastener for retaining said fitting band assembly in engagement with said panel.

7. A fence system as recited in claim 1, further comprising a plurality of integral strands and integral bonds forming each of said foraminous panels, neighboring ones of said plurality of integral strands being connected at spaced apart locations by said integral bonds, at least two neighboring integral strands abutting and being attached to a non-vertical segment of said support structure with said integral strands being generally vertically oriented.

8. A fence system as recited in claim 7, wherein said panels are formed by selectively separating areas of a sheet of material to form said integral strands and said integral bonds, said integral strands and integral bonds defining said cells, said integral strands being axially elongated, a direction of expansion being defined generally perpendicularly to said integral strands.

9. A fence system as recited in claim 8, wherein abutting integral strands in said overlapping area of said neighboring panels nest when said cells of said neighboring panels are aligned, said nesting of said integral strands facilitating interengagement of said neighboring panels.

10. A fence system as recited in claim 1, wherein said neighboring foraminous panels define nesting apertures, said nesting apertures of said neighboring panels in said overlapping area interengaging, said reinforcing member having a width measured generally transverse to an axis of elongation being at least as wide as an interengaged, nested pair of apertures.

11. A fence system as recited in claim 1, wherein said reinforcing member having a width measured generally transverse to an axis of elongation being generally equal to the width of said overlapping area of said neighboring panels.

12. A reinforcing system in combination with a foraminous panel fence system, said fence system including a support structure and a plurality of foraminous panels attached to said support structure, said foraminous panels defining a plurality of cells neighboring panels of said plurality of panels defining an overlapping area, said reinforcing system comprising:

a fastener having a shank and a head formed on one end of said shank;

a retaining portion attachable to said shank for securing said fastener to said panel;

at least one elongated reinforcing member for placement over said overlapping area on said attack side of said barrier between said head of said fasteners and the overlapping one of said neighboring foraminous panels, said fasteners extending through apertures in said reinforcing member and, said elongated reinforcing member defining a prime axis of elongation through corresponding aligned cells of said foraminous panels for securing said reinforcing member to said attack side of said barrier, said reinforcing member strengthening said overlapping area and providing additional deterrence to prevent a breach of said barrier.

13. A reinforcing system in combination with a foraminous panel fence system as recited in claim 12, wherein said apertures in said reinforcing member are elongated apertures extending along a second axis of elongation related to said primary axis of elongation of said elongated reinforcing member for facilitating adjustment of said elongated reinforcing member relative to said overlapping area to substantially align said elongated apertures with corresponding ones of said cells in said overlapping area of said neighboring foraminous panels.

14. A reinforcing system in combination with a foraminous panel fence system as recited in claim 12, further including a force distributor positioned, on said attack side between said head of said fastener and said reinforcing member for distributing the forces created by said fastener against said reinforcing member over a greater area of the abutting surface of said reinforcing member proximate to said fastener.

15. A reinforcing system in combination with a foraminous panel fence system as recited in claim 12, further comprising at least one horizontally oriented reinforcing member and least one vertically oriented reinforcing member, said at least one vertically oriented reinforcing member being secured to said panels of said fence system extending over said overlapping area of the neighboring foraminous panels.

16. A reinforcing system in combination with a foraminous panel fence system as recited in claim 12, further comprising at least one horizontally oriented reinforcing member and at least one vertically oriented reinforcing member, said at least one vertically oriented reinforcing member being secured to said panels of said fence system extending over said overlapping area of the neighboring foraminous panels, and said at least one horizontally oriented reinforcing member being secured to a lower portion of said foraminous panels attached to said support structure.

17. A reinforcing system in combination with a foraminous panel fence system as recited in claim 12, further comprising a fitting assembly attachable to said panel and said support structure, said fitting assembly comprising:

at least one generally planar fitting band having two apertures therethrough at spaced apart locations, said generally planar fitting band being positioned on said attack side of said barrier;

at least one partially arcuate fitting band having two apertures therethrough at spaced apart locations generally coincident with said apertures in said generally planar fitting band, said partially arcuate fitting band being positioned on said secure side of said barrier, said arcuate portion overlying a portion of said support structure;

a fitting assembly fastener extending through aligned pairs of said apertures of said generally planar fitting band, said partially arcuate fitting band and through a corresponding cell of said foraminous panel between said aligned pairs of said apertures for attaching said fitting assembly to said panel; and a nut attached to said fitting assembly fastener for retaining said fitting band assembly in engagement with said panel.

18. A fence system having a support structure and a plurality of foraminous panels attached thereto defining a barrier configured with portions of neighboring ones of said panels overlapping and defining overlapping areas, said barrier defining an attack side and a secure side, a fastener having a shank and a head formed on one end of said shank, a retaining portion attachable to said shank for securing said fastener to said panel, each of said panels having a plurality of open calls therein, said neighboring panels being oriented for aligning a plurality of corresponding one of said cells in said overlapping area, at least one of said fasteners extending through said aligned corresponding cells for attaching said neighboring panels, said head of said fastener positioned against said attack side of said barrier, and at least one elongated reinforcing member defining a primary axis of elongation positioned over said overlapping area on said attack side of said barrier, said reinforcing member having a width measured generally transverse to said primary axis of elongation being generally as wide as said overlapping area, elongated apertures in said reinforcing member extending along a second axis of elongation relative to said primary axis of elongation of said elongated reinforcing member for adjusting said elongated reinforcing member relative to said overlapping area to substantially align said elongated apertures with said corresponding cells in said overlapping area, said fasteners extending through said elongated apertures in said reinforcing member for securing said reinforcing member to said attack side of said barrier, said reinforcing member strengthening said overlapping area and providing additional deterrence to prevent a breach of said barrier.

19. A fence system as recited in claim 18, further comprising at least one horizontally oriented reinforcing member and least one vertically oriented reinforcing member, said at least one vertically oriented reinforcing member being secured to said panels over said overlapping area of the neighboring foraminous panels.

20. A fence system as recited in claim 18, further comprising a fitting assembly attachable to said panel and said support structure, said fitting assembly comprising:

at least one generally planar fitting band having two apertures therethrough at spaced apart locations, said generally planar fitting band being positioned on said attack side of said barrier;

at least one partially arcuate fitting band having two apertures therethrough at spaced apart locations generally coincident with said apertures in said generally planar fitting band, said partially arcuate fitting band being positioned on said secure side of said barrier, said arcuate fitting band overlying a portion of said support structure;

a fitting assembly fastener for extending through aligned pairs of said apertures of said generally planar fitting band and said partially arcuate fitting band and extending through a corresponding cell of said foraminous panel between said aligned pairs of said apertures for attaching said fitting assembly to said panel; and a fitting assembly retaining portion attached to said fitting assembly fastener for retaining said fitting assembly in engagement with said panel.

* * * * *

UNITED STATES PATENT AND TRADEMARK OFFICE

CERTIFICATE OF CORRECTION

PATENT NO. : 5,556,080
DATED : September 17, 1996
INVENTOR(S) : Larry L. Vise

It is certified that error appears in the above-indentified patent and that said Letters Patent is hereby corrected as shown below:

Column 1, Line 16 "offence" should be -- of fence --

Column 3, Line 24 "cell lo apertures" should be -- cell apertures --

Column 4, Line 54 "limit lo the" should be -- limit the --

Column 9, Lines 9-10 "thereby lo reducing" should be -- thereby reducing --

Column 9, Line 41 "reliable lo" should be -- reliable --

Column 11, Line 28 "firing" should be -- fitting --

Signed and Sealed this

Twenty-fifth Day of February, 1997

Bruce Lehman

*Attest:*

BRUCE LEHMAN

*Attesting Officer*

*Commissioner of Patents and Trademarks*